United States Patent [19]

Naudet

[11] Patent Number: 5,039,277

[45] Date of Patent: Aug. 13, 1991

[54] VARIABLE STATOR VANE WITH SEPARATE GUIDE DISK

[75] Inventor: Jacky Naudet, Evry, France

[73] Assignee: Societe National d'Etude et de Construction de Moteurs d'Aviation, Paris, France

[21] Appl. No.: 513,862

[22] Filed: Apr. 24, 1990

[30] Foreign Application Priority Data

Apr. 26, 1989 [FR] France ..... 89 05517

[51] Int. Cl.[5] ..... F01D 17/00

[52] U.S. Cl. ..... 415/150; 415/156; 415/160

[58] Field of Search ..... 415/148, 150, 151, 156, 415/159, 163, 208.1, 208.2, 191, 192, 160; 384/907.1

[56] References Cited

U.S. PATENT DOCUMENTS

| | | | |
|---|---|---|---|
| 2,933,235 | 4/1960 | Neumann | 415/150 |
| 2,955,744 | 10/1960 | Hemsworth | 415/147 |
| 3,059,902 | 10/1962 | Savonuzzi | 253/78 |
| 3,723,021 | 3/1973 | Bartholomew | 230/114 |
| 4,666,318 | 5/1987 | Harrison | 384/907.1 |
| 4,706,354 | 11/1987 | Naudet et al. | 415/160 |
| 4,710,036 | 12/1987 | Geczy | 384/907.1 |
| 4,773,821 | 9/1988 | Gonthier et al. | 415/150 |
| 4,792,277 | 12/1988 | Dittberner, Jr. et al. | 415/160 |

FOREIGN PATENT DOCUMENTS

| | | | |
|---|---|---|---|
| 0298894 | 1/1989 | European Pat. Off. . | |
| 2599785 | 12/1987 | France . | |
| 2740192 | 3/1979 | Netherlands | 415/159 |
| 1223390 | 2/1971 | United Kingdom . | |
| 1505858 | 3/1978 | United Kingdom . | |
| 2027811 | 2/1980 | United Kingdom . | |

*Primary Examiner*—Edward K. Look
*Assistant Examiner*—Hoang Nguyen
*Attorney, Agent, or Firm*—Bacon & Thomas

[57] ABSTRACT

A variable vane assembly for a gas turbine engine is disclosed having a disk member bearing against a recess formed in the inner surface of the gas turbine engine casing is formed separately from the vane. The disk member has a diametrical notch that accommodates a strip member formed integrally with the vane and which extends generally parallel to the chord of the vane. The control rod, which is also formed integrallly with the vane, passes through an opening defined by the disk member and is pivotally supported by the engine casing. A low friction sleeve may be interposed between the control rod and the opening defined by the engine casing to reduce the pivoting friction of the vane. This sleeve may be formed as a separate element, or may be formed integrally with the disk member, which may also be formed of low-friction material.

11 Claims, 1 Drawing Sheet

VARIABLE STATOR VANE WITH SEPARATE GUIDE DISK

BACKGROUND OF THE INVENTION

The present relates to a variable stator vane for a gas turbine engine, more specifically such a variable stator vane having a separate guide disk in order to render the fabrication of the stator vane more economical.

Variable stator vanes for gas turbine engines are well known in the art and, as illustrated in FIGS. 1 and 2, comprise vane assemblies 1 having a stator vane 2 mounted in the casing 3 of the gas turbine engine. A control pivot rod 4 pivotally supports the upper end of the vane 2 by passing through a bore 5 defined in a boss 6 extending outwardly from the casing 3. In order to transmit and distribute the stresses from the vane 2 to the casing 3, a disk portion 7 is formed on the upper and of the vane 2 such that it extends into a recess 8 defined by the inner surface of the casing 3. The relatively large area of contact between the disk member 7 and the recess 8 minimizes the stress concentrations between the vane 2 and the casing 3.

As is typical, the disk 7 is formed integrally with the vane 2 and the control rod 4. These elements are machined from one piece of a steel or an alloy ingot, usually by electrochemical machining techniques. As a rule, the diameter of disk member 7 is generally equal to the chord "c" of the vane 2. Thus, it is necessary to start the machining process with an ingot that has a width at least equal to the chord of the vane and a thickness at least equal to width of the member 7. Quite obviously, this results in a great waste of the steel or alloy material and a consequent increase in costs of the fabrication of such stator vanes. French Patent 2,599,785 discloses a vane structure wherein the disk member is formed in one piece with the vane.

It is also known to form a movable vane assembly by separately fabricating the disk and subsequently brazing or welding it to the vane member. This technique is illustrated in U.S. Pat. No. 2,955,744 to Hemsworth and U.K. patent application 2,027,811A. While such techniques lower the cost of fabrication, there is always the danger of the failure of the braze or weld which may cause catastrophic failure of the gas turbine engine.

SUMMARY OF THE INVENTION

A variable vane assembly for a gas turbine engine is disclosed wherein the disk member bearing against the inner surface of the gas turbine engine casing is formed separately from the vane. The disk member has a diametrical notch that accommodates a strip member formed integrally with the vane and which extends generally parallel to the chord of the vane. The control rod, which is also formed integrally with the vane, passes through an opening defined by the disk member and is pivotally supported by the engine casing.

The invention enables the reduction in the fabrication costs of the vane assembly, since it reduces the dimensions of the ingot that is necessary at the beginning of the fabrication process. The ingot need only have thickness that is slightly greater than the strip member on the vane which is substantially less than the dimensions of the disk member.

The invention also avoids the necessity of brazing or welding the disk to the vane, thereby eliminating the possibility of failure of the brazed or welded joints.

A low friction sleeve may be interposed between the control rod and the opening defined by the engine casing to reduce the pivoting friction of the vane. This sleeve may be formed as a separate element, or may be formed integrally with the disk member, which may also be formed of low-friction material.

DETAILED DESCRIPTION OF THE PREFERRED EMBODIMENTS

Figure 1:
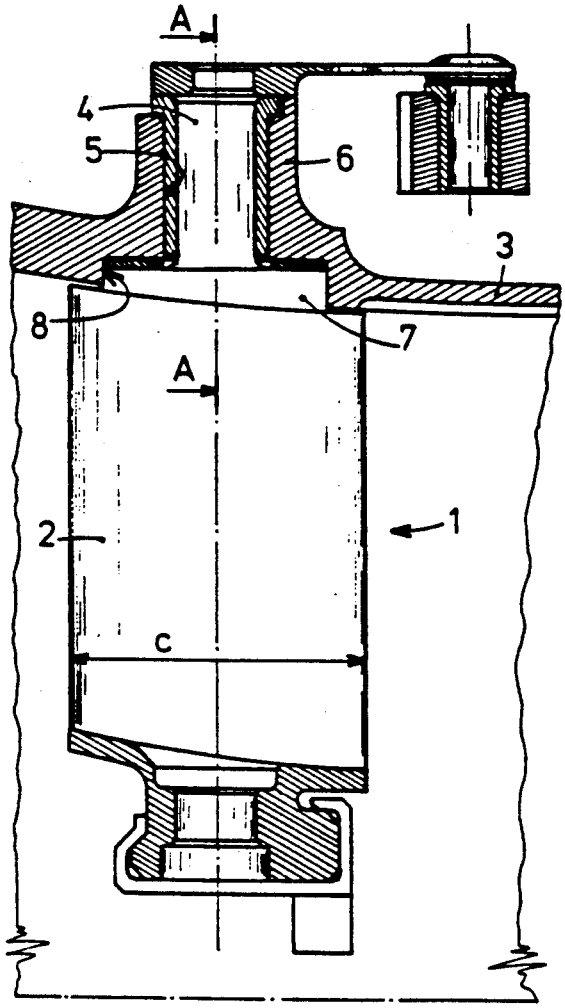
FIG : 1 (PRIOR ART)
FIG. 1 is an partial, longitudinal cross-sectional view of a variable vane assembly according to the prior art.
Figure 2:
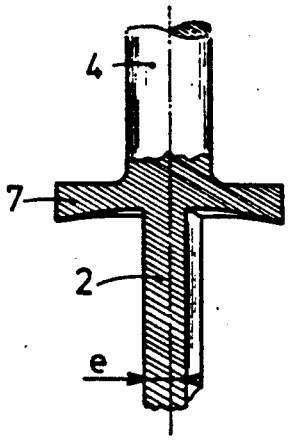
FIG : 2 (PRIOR ART)
FIG. 2 is a partial, sectional view taken along line A—A in FIG. 1.
Figure 4:
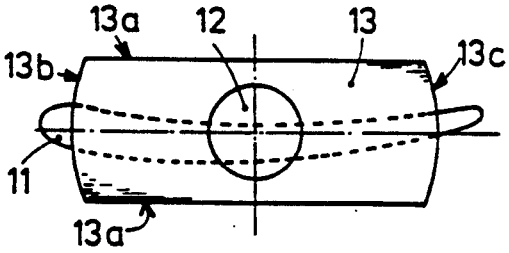
FIG. 4 is a top view of the vane assembly in FIG. 3 with the disk member removed for clarity.
Figure 3:
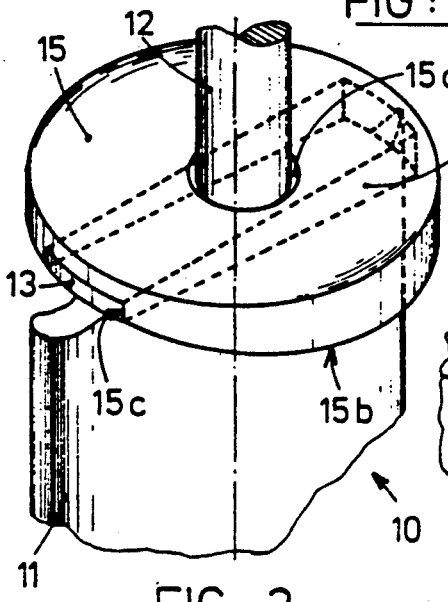
FIG. 3 is a partial, perspective view of the vane assembly according to the present invention.

The vane assembly 10 according to the present invention is illustrated in FIGS. 3 and 4 and comprises a vane 11 having a control rod 12 formed integrally therewith and extending from the top of the vane. Also formed integrally with the vane 11 is a strip member 13 having a generally parallelepiped shape with opposite longitudinal sides **13*a* extending generally parallel to the chord of the vane 11. The upstream and downstream ends 13*b* and 13*c* of the strip member 13 have arcuate shapes, the arcs having a diameter generally equal to that of the disk member 15, to be described in more detail hereinafter. The curvature of these opposite ends 13*b*, 13*c* is centered on the pivot axis of the control rod 12**.

A generally circular disk member 15 is mounted on the vane. The disk member 15 defines a center opening **15*a* that slidably accommodates the control rod 12 and enables the disk 15 to be slipped over the control rod. The inner surface 15*b* of the disk 15 defines a groove 15*c* extending across its diameter and dimensioned so as to receive the strip member 13 of the vane 11. Thus, as illustrated in FIG. 3, the disk member 15 slides down over the control rod 12 and the strip member 13. Interengagement of the groove 15*c* with the strip member 13 causes the disk 15 to pivot as the vane 11 pivots around the axis of the control rod. The ends 13*b* and 13*c* of the strip member 13 are generally flush with the perimeter of disk member 15**.

The inner surface **15*b* assumes a generally concave shape such that, when the assembly is installed in the engine casing, the inner surface 15*b*** will substantially conform to the inner surface of the casing.

Figure 5:
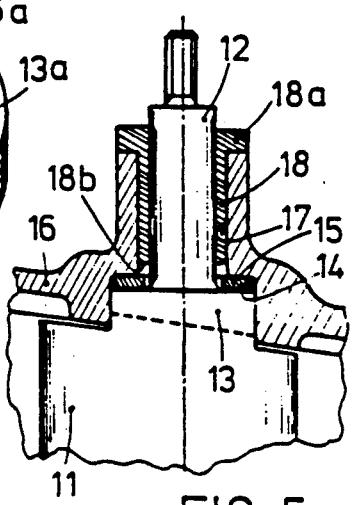
FIG. 5 is a partial, longitudinal cross-sectional view illustrating a first embodiment of the attachment of the vane assembly in FIG. 3 to the engine casing.

A first embodiment for mounting the vane assembly 10 to the engine casing 16 is illustrated in FIG. 5. As can be seen, the casing 16 has an outwardly extending boss which defines a radially extending opening 17 through which the control rod 12 extends. The inner surface of the casing 16 defines a recess 14 having a generally cylindrical configuration with a diameter slightly larger than that of the disk member 15 so as to pivotally accommodate the disk member 15 and the strip member 13 therein.

A sleeve 18, formed of a low-friction material, has an external shoulder **18*a* which bears against the external portion of the casing boss and extends into the radial opening 17 around the control rod 12 to pivotally support the control rod 12. The innermost end 18***b* of the sleeve 18 is spaced apart from the upper surface of the disk 15. In this embodiment, the sleeve 18 is inserted from the exterior of the casing, while the vane assembly 10 is inserted from the interior of the casing 16 such that control rod 12 extends through the opening defined by the sleeve 18. The disk 15 is slightly recessed in the recess 14 in order to prevent any projection of this element into the airstream when the vanes 11 are angularly moved.

Figure 6:
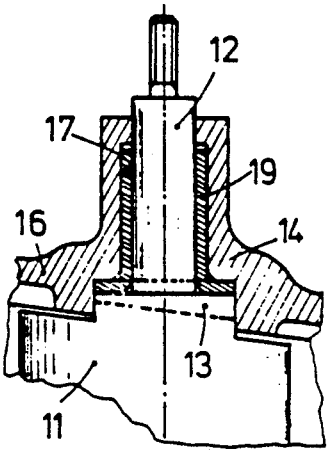
FIG. 6 is a partial, longitudinal cross-sectional view illustrating a second embodiment of the mounting of the vane assembly of FIG. 3 in the engine casing.

A second embodiment for mounting the vane assembly 10 in the casing 16 is illustrated in FIG. 6. In this embodiment, the low-friction sleeve and the disk member have been formed as a single unit which is designated by number 19. Thus, the sleeve portion of element 19 extends generally outwardly through a portion of the opening 17 so as to pivotally support the control rod 12. In this embodiment, the vane assembly 10, with the element 19 assembled thereon is installed through the inside of the casing 16 until the disk portion of the unit 19 bears against the bottom of the casing opening 17.

In both of the embodiments shown in FIGS. 5 and 6, the disk 15 or the combined disk/sleeve 19 may be fabricated from a low-friction material. This material may be a sintered carbon material, such as the commercially available VESPEL, or a braided-fiber reinforced colloid such as the commercially available AVIMID.

The vane assembly according to this invention allows the reduction of the blank volume between 45–65% over the prior art vanes. The amount of reduction will depend upon the desired width of the strip member 13. By reducing the size of the blank, the ECM machining is commensurately shortened, reducing the cost of the vane by an estimated 20%. The invention also enables the weight of the vane assembly to be reduced, since the separate disk member may be formed of a composite material having a density lower than that of the material from which the vane is fabricated.

The foregoing description is provided for illustrative purposes only and should not be construed as in any way limiting this invention, the scope of which is defined solely by the appended claims.

What is claimed is:

1. A variable vane assembly for a gas turbine engine having a generally annular casing defining an inner surface comprising:

a) a vane having:

i) an airfoil portion having an airfoil shaped cross-sectional configuration, the airfoil portion defining an end;

ii) a strip member formed integrally with the airfoil portion and located on the end of the airfoil portion, the strip member having a generally parallelepiped configuration with opposite sides extending generally parallel to the chord of the airfoil portion; and, iii) a control rod extending from the end of the vane, the control rod defining a pivot axis;

b) a generally circular disk member located on the vane defining an opening to accommodate passage of the control rod therethrough and defining a generally diametrically extending groove adapted to accept the generally parallelepiped strip member of the vane therein such that pivotal movement of the vane about the pivot axis causes pivotal movement of the disk member, wherein the length of the strip member is substantially equal to a diameter of the disk member;

c) an opening defined by the engine casing to pivotally accept the control rod; and, d) a recess defined by the engine casing generally aligned with the opening to pivotally accept the disk member.

2. The variable vane assembly according to claim 1 wherein opposite upstream and downstream ends of the strip member are formed as arcs of a circle having a diameter substantially equal to the diameter of the disk member.

3. The variable vane assembly according to claim 1 wherein the disk member defines an inner surface configured to generally conform to the inner surface of the annular casing.

4. The variable vane assembly according to claim 1 wherein the engine casing defines an outwardly extending boss which defines the opening for the control rod and further comprising a sleeve inserted into the opening around the control rod.

5. The variable vane assembly according to claim 4 further comprising an external shoulder formed on the sleeve and located so as to bear against the boss.

6. The variable vane assembly according to claim 4 wherein the sleeve has an inwardly facing end spaced apart from the disk member.

7. The variable vane assembly according to claim 4 wherein the sleeve is formed integrally with the disk member.

8. The variable vane assembly according to claim 7 wherein the integral sleeve and disk member is made of a sintered carbon material.

9. The variable vane assembly according to claim 7 wherein the integral sleeve and disk member is made of a braided fiber reinforced colloidal material.

10. The variable vane assembly according to claim 4 wherein the sleeve is made of a sintered carbon material.

11. The variable vane assembly according to claim 4 wherein the sleeve is made of a braided fiber reinforced colloidal material.

* * * * *

UNITED STATES PATENT AND TRADEMARK OFFICE

CERTIFICATE OF CORRECTION

PATENT NO. : 5,039,277

DATED : August 13, 1991

INVENTOR(S) : NAUDET

It is certified that error appears in the above-identified patent and that said Letters Patent is hereby corrected as shown below:

Col. 1, line 1, after "The present" insert --invention--;
line 19, delete "and" and insert --end--.

Col. 2, line 9, delete "an" and insert --a--.

Signed and Sealed this

Eighth Day of June, 1993

Michael K. Kirk

*Attest:*

MICHAEL K. KIRK

*Attesting Officer*

*Acting Commissioner of Patents and Trademarks*